United States Patent [19]

Compeau et al.

[11] Patent Number: 4,869,537

[45] Date of Patent: Sep. 26, 1989

[54] COMPARTMENT PANEL PULL DOWN MECHANISM

[75] Inventors: David E. Compeau, Mt. Clemens; William L. Priest, Rochester, both of Mich.

[73] Assignee: General Motors Corporation, Detroit, Mich.

[21] Appl. No.: 143,779

[22] Filed: Jan. 14, 1988

[51] Int. Cl.[4] ..... E05B 15/02

[52] U.S. Cl. ..... 292/341.18; 292/DIG. 25

[58] Field of Search ..... 292/341.18, DIG. 25, 292/DIG. 29, DIG. 43, 141, 170, 144, 171, 341.16

[56] References Cited

U.S. PATENT DOCUMENTS

| | | | |
|---|---|---|---|
| 2,316,692 | 4/1943 | Hill | 292/171 |
| 2,896,990 | 7/1959 | Garvey et al. . | |
| 2,903,288 | 9/1959 | Joachim et al. . | |
| 2,916,319 | 12/1959 | DuBois . | |
| 2,943,880 | 7/1960 | Joachim et al. . | |
| 2,994,550 | 8/1961 | White . | |
| 3,056,619 | 10/1962 | Fox et al. | 292/DIG. 43 X |
| 3,081,078 | 3/1963 | Lohr | 292/DIG. 43 X |
| 3,403,934 | 10/1968 | Butts . | |
| 3,835,678 | 9/1974 | Meyer et al. | 292/341.16 X |
| 4,478,441 | 10/1984 | Fiordellisi et al. | 292/DIG. 25 X |
| 4,544,189 | 10/1985 | Fiordellisi et al. | 292/DIG. 25 X |
| 4,739,585 | 4/1988 | Pickles | 49/280 |
| 4,746,153 | 5/1988 | Compeau et al. | 292/216 |

*Primary Examiner*—Kenneth J. Dorner
*Assistant Examiner*—José V. Chen
*Attorney, Agent, or Firm*—Charles E. Leahy

[57] ABSTRACT

Mechanism for pulling an opened compartment panel closed and engaging a latch with a striker includes a slide member mounted on the body for horizontal reciprocating movement and having a cam slot which receives a cam follower carried by the striker so that horizontal reciprocating movement of the slide member vertically reciprocates the striker. The cam slot includes an inclined cam surface effective to provide the vertical reciprocation of the striker. The cam slot also includes a horizontal dwell surface at the end of the inclined surface to define the retracted position of the striker in which the compartment panel is closed so that the load imposed on the compartment lid in the direction to pry open the compartment panel is prevented from urging the slide member in a direction which would permit the striker to extend. A second horizontal dwell surface at the other end of the inclined surface defines the extended position of the striker so that a slamming movement of the compartment panel toward the closed position latching the latch with the striker is prevented from urging movement of the slide member in a direction to permit retraction of the striker. Thus, the pull down mechanism is constructed so that a vertical load imposed on the striker when the compartment panel is slammed or when the compartment panel is pried open is not exerted on the motorized drive unit.

7 Claims, 5 Drawing Sheets

COMPARTMENT PANEL PULL DOWN MECHANISM

The invention relates to a latch mechanism for a vehicle compartment panel and more particularly provides for a pull down mechanism for pulling a deck lid panel to the fully closed position.

BACKGROUND OF THE INVENTION

It is well known in the prior art to provide a vehicle body compartment panel, such as a rear deck lid, which is hingedly mounted and spring loaded for movement to an open position. A latch assembly is mounted on the compartment panel and has a latch bolt which is spring biased to an unlatched position. When the deck lid is slammed to a closed position, the latch bolt latches with a striker mounted on the vehicle body to latch the panel in a closed position. The latch assembly traditionally includes a detent lever which holds the latch bolt in the latch position, and a key cylinder for releasing the detent lever from the latch bolt so that the latch bolt is spring biased to the unlatched position releasing the panel for movement to its open position.

It is also well known in the prior art to provide a motorized pull down mechanism for pulling the panel to the fully closed position, thereby eliminating the need for the user to slam the panel. The pull down mechanism traditionally includes a housing mounted on the vehicle body and having the striker mounted thereon by a motorized vertically movable drive unit for movement between an extended position and a retracted position. When the striker is extended, closing movement of the panel causes the latch bolt to engage the striker so that the panel and the striker are latched together. This engagement closes a switch and energizes the motorized drive unit to retract the striker and thereby pull the panel to the fully closed position. When the panel is returned to the fully open position by operating the key, or by a remote electrical operation from inside the passenger compartment, the motorized drive unit reverses and the striker is moved from the retracted position to the extended position in readiness for subsequent engagement by the latch bolt upon closing movement of the panel.

The present invention provides a new and improved mechanism for moving the body mounted striker vertically between the retracted and extended positions and isolating the motorized drive unit from forces imposed on the striker during slamming of the compartment panel and/or an attempt to pry the compartment panel open.

SUMMARY OF THE INVENTION

According to the invention a housing is mounted on the vehicle body panel which defines the compartment opening and a slide member is mounted on the housing for horizontal reciprocating movement. The slide member has a cam slot which receives a cam follower carried by the striker so that horizontal reciprocating movement of the slide member vertically reciprocates the striker. The slide member is connected to the motorized drive unit by a cable which is pulled by the motor to pull the slide member in the direction of retracting the striker and a spring acts upon a slide member to urge the slide member in the direction to extend the striker when the motor relieves the tension from the cable. The cam slot includes an inclined cam surface effective to provide the vertical reciprocation of the striker. The cam slot also includes a horizontal dwell surface at the end of the inclined surface to define the retracted position of the striker in which the compartment panel is closed so that the load imposed on the compartment lid in the direction to pry open the compartment panel is prevented from urging the slide member in a direction which would permit the striker to extend. In addition, a second horizontal dwell surface is provided at the other end of the inclined surface to define the extended position of the striker so that a slamming movement of the compartment panel toward the closed position latching the latch with the striker is prevented from urging movement of the slide member in a direction to permit retraction of the striker.

Accordingly, the object, feature and advantage of the invention resides in a pull down mechanism in which forces imposed on the compartment panel striker are prevented from imposing a load on the motorized drive unit.

BRIEF DESCRIPTION OF THE DRAWINGS

These and other features, objects, and advantages of the invention are more fully understood by reference to the following description of the preferred embodiment and the appended drawings in which.

DESCRIPTION OF THE PREFERRED EMBODIMENT

Figure 1:
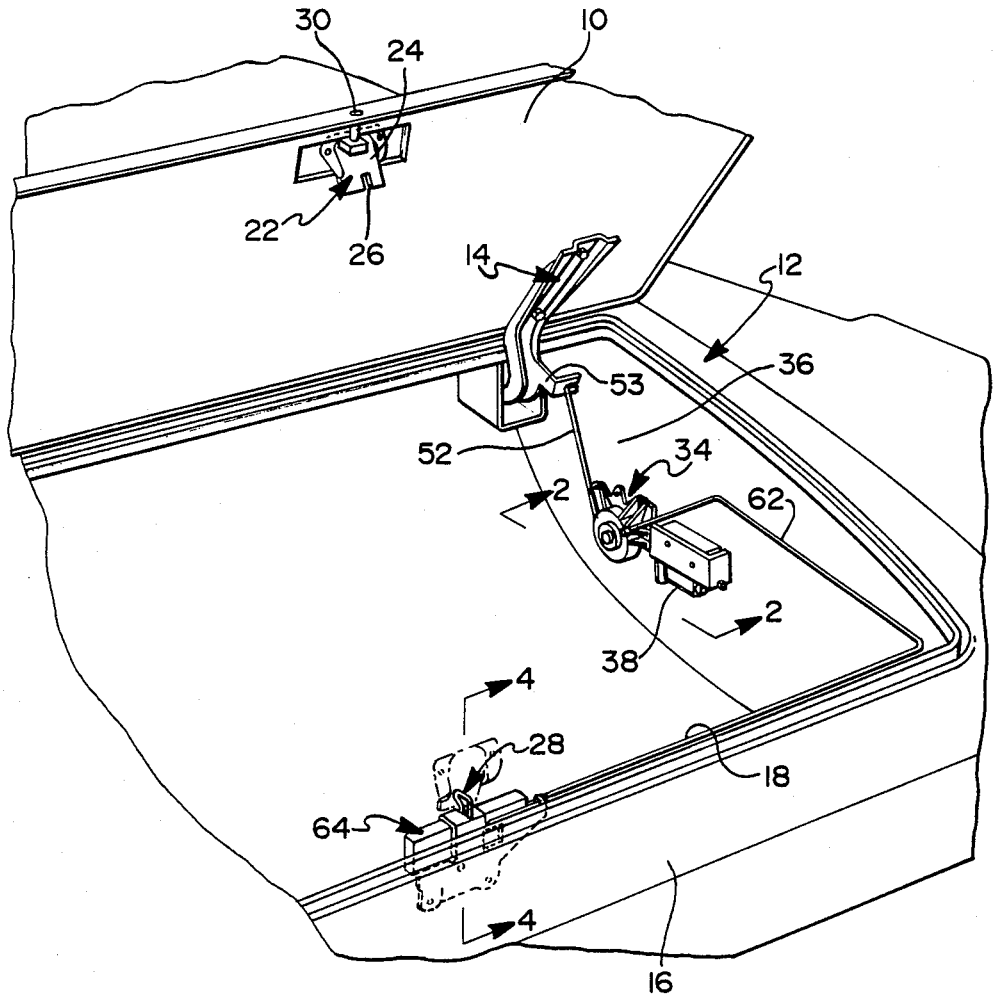
FIG. 1 is a perspective view of a vehicle body compartment and compartment closure panel having a pull down mechanism according to the invention.

Referring to FIG. 1, a deck lid compartment panel 10 is hingedly mounted on a vehicle body 12 by a pair of hinges, one of which is shown at 14. Body panel 16 of the vehicle body 12 defines a compartment opening 18 which is opened and closed by the compartment panel 10. A spring, not shown, urges the compartment panel 10 to the open position shown in FIG. 1.

The compartment panel 10 may be latched in a closed position by a latch assembly, generally indicated at 22, which is mounted on the compartment panel 10. The latch assembly 22 includes a housing 24 having a latch bolt 26 pivotally mounted thereon. The latch bolt 26 is engageable with a striker 28 carried by the body panel 16 to latch and interconnect the compartment panel 10 with the body panel 16. The latch assembly 22 includes a latch bolt spring, not shown, which biases the latch bolt 26 to an unlatched position. When the compartment panel 10 is moved toward closed position, the latch bolt 26 engages the striker 28 and is thereby pivoted to a latching position with respect to striker 28. The latch assembly 22 includes a detent lever, not shown, which maintains the latch bolt in the latched position with respect to the striker 28.

The latch assembly 22 also includes a key operated lock cylinder 30 which is rotatable when a properly bitted key is inserted. Rotation of the key cylinder pivots the detent lever out of engagement with the latch bolt 26 and permits the latch bolt spring to return the latch bolt to its unlatched position, thereby disconnecting the latch assembly 22 from the striker 28 and enabling the compartment panel 10 to be moved to its FIG. 1 open position by the compartment panel spring.

Figure 2:
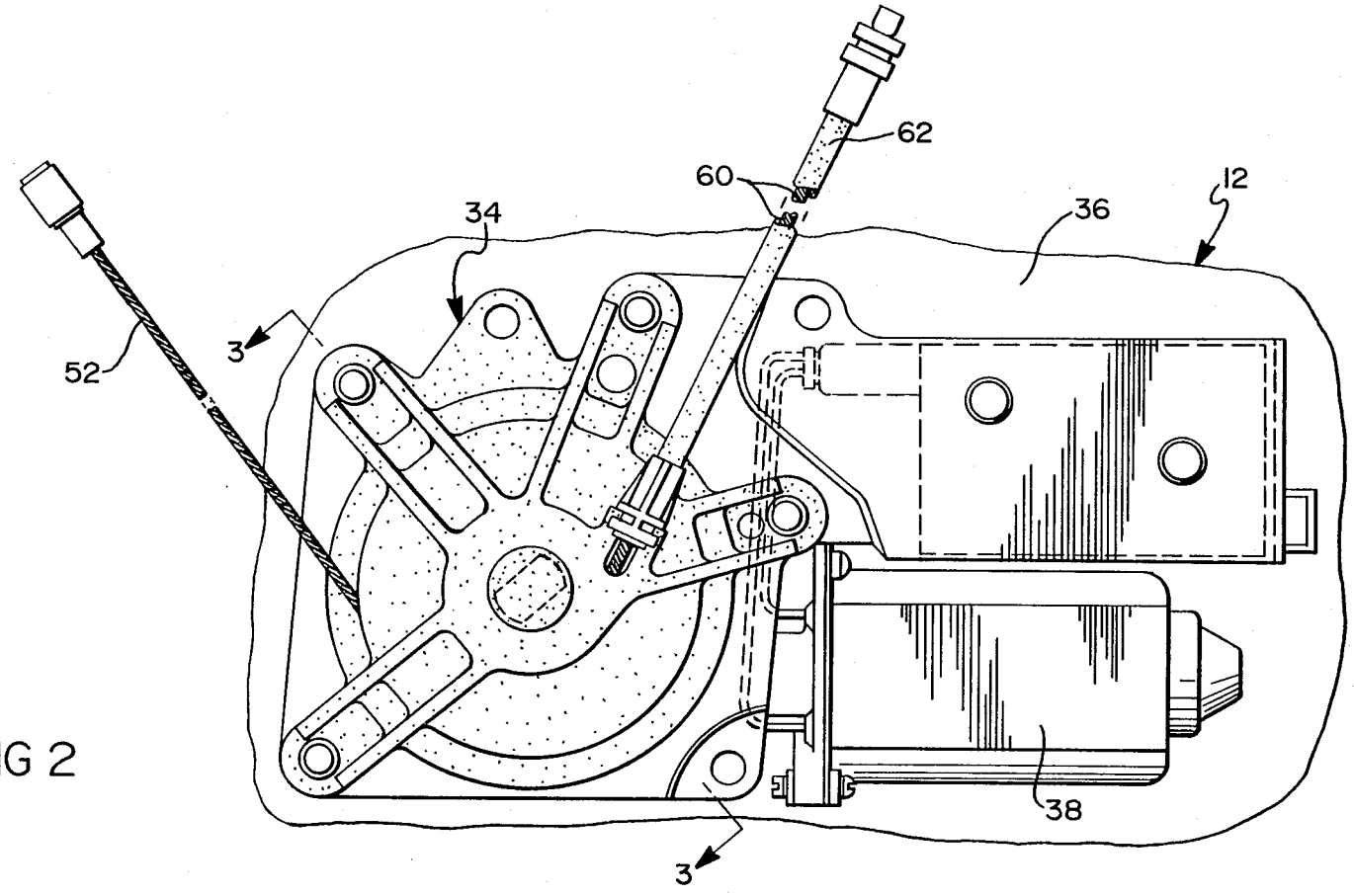
FIG. 2 is a side elevation view of the motorized drive unit for closing the deck lid and pulling the deck lid down to the fully closed position.
Figure 3:
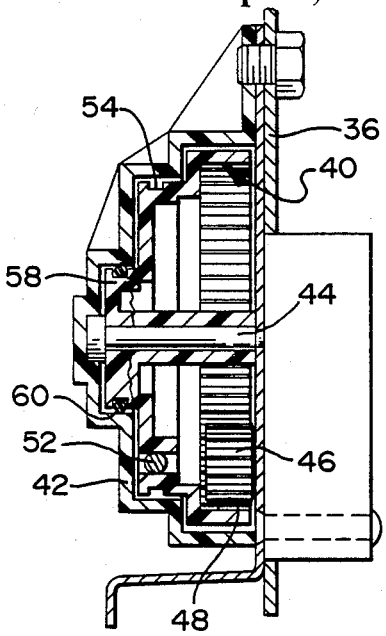
FIG. 3 sectional view taken in the direction of 3—3 of FIG. 2.

Referring again to FIG. 1, it is seen that a motorized drive unit generally indicated at 34, is provided to pull down compartment panel 10 to latch the latch assembly 22 with the striker 28 and to also pull down the striker 28 to seal the compartment panel 10 at its fully closed position. As best seen in FIG. 2, motorized pull down unit 34 is mounted on the side wall structure 36 of the vehicle body 12 and includes a motor 38 which reversibly rotates a cable drum 40, best shown in FIG. 3. The cable drum 40 is rotatably mounted inside a housing 42 by a shaft 44. A drive pinion 46 is connected to the motor 38 by a suitable gear transmission and meshes with teeth 48 provided on the inside of cable drum 40. As seen in FIGS. 1, 2 and 3, a cable 52 is connected to an offset arm 53 of the compartment panel hinge 14 and wraps around a pulley 54 of the cable drum 40. The innermost end of the cable 52 is anchored on the drum 40 so that rotation of the drum winds the cable 52. In particular, the counterclockwise rotation of the drum 40, as viewed in FIG. 2, winds up the cable 52 and pulls the compartment panel 10 down toward the closed position.

The motorized drive unit also includes a second pulley 58 of the drum 40 which has a cable 60 attached thereto. As best seen by reference to FIG. 2, the cable 60 is wrapped around the drum 40 in the opposite direction of the cable 52 so that drum rotation in the direction to wind and retract cable 52 will extend the cable 60. The cable 60 is routed through a sheath 62 which extends to a pull down mechanism 64 for the striker 28.

Figure 4:
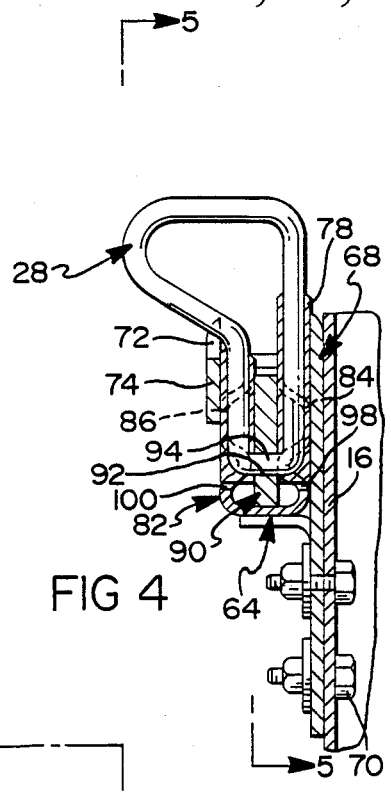
FIG. 4 is a sectional view taken in the direction of arrows 4—4 of FIG. 1 and showing the pull down mechanism according to the present invention.
Figure 5:
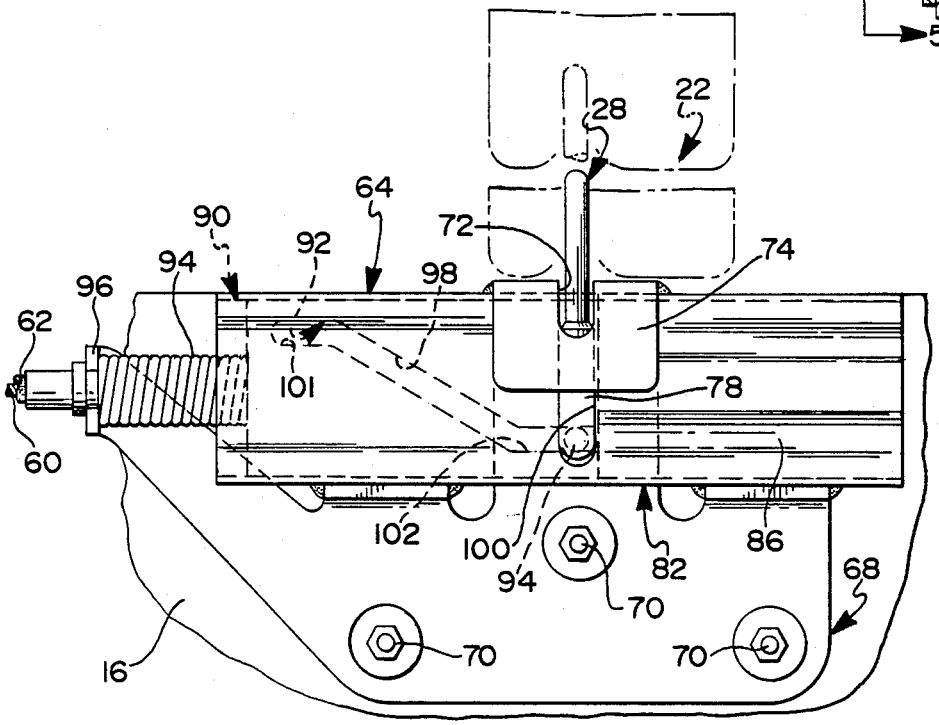
FIG. 5 is a view of the pull down mechanism in the direction 5—5 of FIG. 4.

The pull down mechanism 64 for the striker 28 is shown in FIGS. 1, 4 and 5. The pull down mechanism includes a housing 68 bolted to the body panel 16. The striker 28 is defined by a bent rod and is captured within a slot 72 defined in a flange portion 74 of the housing 68. The bottom most portion of the striker 28 is encapsulated in the shoe 78 which is slidably captured between the housing 68 and flange 74 to mount the striker 28 for up and down movement. A U-shaped track 82 is mounted on the housing 68 and has upstanding legs 84 and 86 which slidably capture a slide member 90. As best seen in FIG. 5, the slide member 90 has a cam slot 92 therein which receives the lowermost leg 94 of the striker 28, thereby defining a cam follower which rides in the cam slot 92 of the slide member 90. The upstanding legs 84 and 86 of the U-shaped track 82 respectively have vertical extending slots 98 and 100 which receive the striker shoe 78 to further define the path of vertical up and down movement of the striker 28.

As best seen in FIG. 5, the cable 60 is attached to the slide member 90 so that a clockwise rotation of the drum 40 as viewed in FIG. 2, will retract the cable 60 and pull the slide member 90 leftwardly. A coil compression spring 94 has one end seated against the slide member 90 and the other end seated against a stop 96 of the housing 68 to urge the slide member 90 rightwardly as viewed in FIG. 5.

As seen in FIG. 5, the cam slot 92 includes a central inclined portion 98, a horizontal dwell portion 101 at the upper end of the inclined portion 98 and a horizontal dwell portion 102 at the lower end of the inclined portion 98. The coil compression spring 94 normally positions the slide member 90 at the rightward position at which the dwell portion 101 of the cam slot 92 establishes the striker 28 at its upwardly extended position of FIGS. 1 and 5.

In order to close the compartment panel, the motor 38 is energized in a direction to rotate the drum 40 in a counterclockwise direction so that the cable 52 is retracted to pull the compartment panel 10 downwardly. At the same time this counterclockwise rotation is extending the cable 60 so that the coil compression spring 94 is permitted to urge the slide member rightwardly so that the inclined portion 98 of the cam slot raises the striker 28 upwardly from the retracted position of FIG. 5 to the phantom indicted extended position in which the dwell portion 100 of the cam slot establishes the striker 28 at its fully extended position.

When the closing movement of the compartment panel 10 carries the latch assembly 22 into engagement with the striker 28, the latch bolt 26 is rotated into latching engagement with the striker 28, thereby coupling the compartment panel with the striker 28. The motor sensing circuit described hereinafter by reference to FIGS. *6a–6b* and 7, senses the increased electrical load obtained when the latch meets the striker and reverses the motor 38 to reverse the direction of rotation of the drum 40. As the drum 40 rotates in a counterclockwise direction, the cable 52 goes slack and the cable 60 is retracted to pull the slide member leftwardly as viewed in FIG. 5. This leftward motion of the slide member 90 causes the inclined portion 98 of the cam slot 92 to traverse the cam follower portion 94 of the striker 28, thereby pulling the striker 28 and the compartment panel latched thereto, downwardly. When the slide member reaches the full leftward position of FIG. 5, the dwell portion 102 of the cam slot 92 is engaged with the cam follower portion 94 of striker 28.

As best seen in FIG. 5, it will be appreciated that a downward or upward acting force on the striker 28 will not impose any force on the motorized drive unit 34 attached thereto by cable 60 whenever the cam follower portion 94 engages with either the horizontal dwell portion 101 or 102. For example, when the striker 28 is in the extended position, the vehicle user may inadvertently slam the compartment panel 10 to the closed position rather than utilize the electric closing feature. The horizontal dwell portion 101 of the cam slot receives this slamming force without imparting a horizontal sliding motion into the slide member 90. Likewise, when the slide member is moved to the full leftward position of FIG. 5 as when the compartment panel is sealed in a fully closed position, any attempt to pry the compartment panel open will force the striker 28 upwardly. However, the engagement between the cam follower portion 94 and the horizontal dwell portion 102 will prevent the transmission of any horizontal sliding forces into the slide member 90. Thus, although a substantial vertical force may be imposed upon the striker 28, the slide member 90 effectively isolates the force from the cable 60 so that the force will not be exerted on the cable drum 40 and the motorized drive unit 34.

Electrical Circuit

Figure 6A:
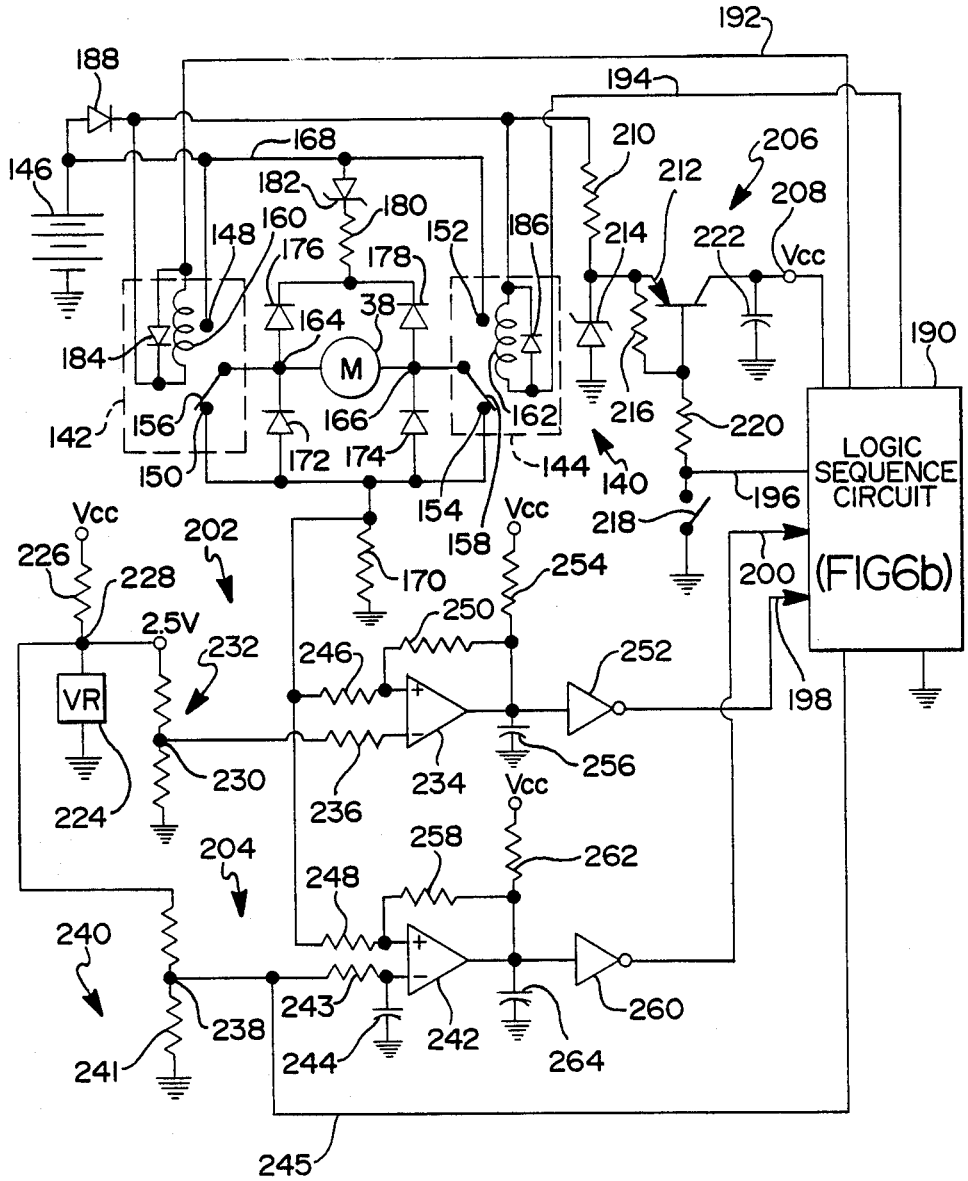
FIGS. 6*a* –6*b* depict a circuit diagram of the control unit in FIG. 1.
Figure 6B:
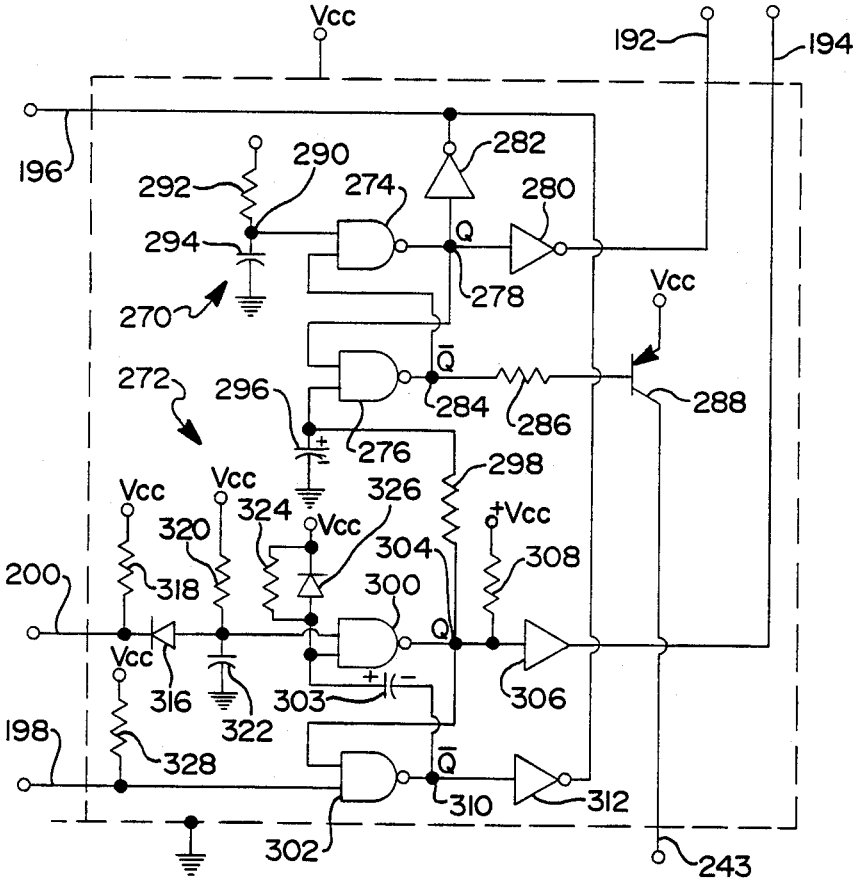

A control unit circuit for carrying out the control of this invention is schematically depicted in FIGS. 6*a* -6*b*. FIG. 6*a* depicts the overall circuit, and FIG. 6*b* depicts a functional block of FIG. 6*a* in greater detail.

Referring particularly to FIG. 6*a*, the reference numeral 140 generally designates a relay switching circuit connected to the motor terminals 164 and 166. The switching circuit 140 comprises a pair of single-pole double-throw relays 142, 144 controllable to bi-directionally energize the motor 38 with direct current from a conventional automotive storage battery 146. The relays 142, 144 each comprise a pair of contacts 148, 150; 152, 154, a switch arm 156, 158 spring biased to engage the lower contact 150, 154 as shown in FIG. 6*a*, and a coil 160, 162 energizeable to overcome the spring bias, moving the switch arm 156, 158 into engagement with the upper contact 148, 152.

The switch arm 156 of relay 142 is connected to the motor terminal 164, and the switch arm 158 of relay 144 is connected to the motor terminal 166. The upper relay contacts 148 and 152 are connected to the positive terminal of battery 146 via line 168. The lower relay contacts 150 and 154 are connected to ground potential and the negative terminal of battery 146 via the current shunt resistor 170.

In the normal, or rest condition, the relays 142 and 144 connect both motor terminals 164 and 166 to ground potential via shunt resistor 170. When counter-clockwise rotation of the motor 38 is required, the relay coil 160 is energized to bring switch arm 156 into engagement with the upper relay contact 148. This completes a first motor energization circuit comprising battery 146, relay contacts 148 and 154, and the shunt resistor 170. When clockwise rotation of the motor 38 is required, the relay coil 162 is energized to bring switch arm 158 into engagement with the upper relay contact 152. This completes a second motor energization circuit comprising battery 146, relay contacts 152 and 150, and the shunt resistor 170.

When a relay coil 160, 162 is deenergized, the respective motor terminal 164, 166 is momentarily open-circuited. At such time, a snubber circuit comprising the freewheeling diodes 172 - 178, the resistor 180, and the Zener diode 182 operates to suppress high voltage transients by returning inductive energy stored in the motor windings to battery 146. The inductive energy stored in the relay coils 160, 162 upon their deenergization is circulated therethrough by a respective freewheeling diode 184, 186.

One terminal of each relay coil 160, 162 is connected to the positive terminal of battery 146 through the diode 188. The other terminals of relay coils 160 and 162 are connected to the LOGIC SEQUENCE CIRCUIT 190 via lines 192 and 194, which circuit selectively connects the lines 192 and 194 to ground potential for energizing the respective relay coils 160 and 162. In performing such control, the LOGIC SEQUENCE CIRCUIT 190 is responsive to a momentary grounding of line 196, and to the motor current limit signals on lines 198 and 200. The current limit signals on lines 198 and 200 are developed by the closing detection circuit 202, and the sealing detection circuit 204, respectively. The LOGIC SEQUENCE CIRCUIT 190 is shown in detail in FIG. 6*b*.

Operating voltage for the LOGIC SEQUENCE CIRCUIT 190 and the closing and sealing detection circuits 202 and 204, designated Vcc, is supplied by battery 146 via the wake-up circuit 206 at the junction 208. The junction 208 is connected to battery 146 via diode 188, resistor 210, and the emitter-collector circuit of transistor 212. The Zener diode 214 protects the transistor 212 from overvoltage transients, and the resistor 216 biases transistor 212 to a normally nonconductive state.

A momentary contact switch 218 disposed in the passenger compartment of the vehicle is adapted to be depressed by the vehicle operator to initiate a deck lid pull down sequence. The switch 218 is connected to the base of wake-up circuit transistor 212 via resistor 220, and biases transistor 212 conductive to develop the operating voltage Vcc at junction 208 when depressed. As described below in reference to FIG. 6*b*, the LOGIC SEQUENCE CIRCUIT 190 senses the momentary depression of switch 218 via line 196, and operates under such condition to latch the transistor in a conductive state by maintaining line 196 substantially at ground potential. When the pull down sequence is completed, as indicated by the sealing detection circuit 204, the LOGIC SEQUENCE CIRCUIT 190 removes the bias, and transistor 212 returns to its normally nonconductive state. Filter capacitor 220 prevents an abrupt loss of the operating voltage Vcc during the latching operation and at the end of the pull down sequence.

The voltage regulator circuit 224 is connected to operating voltage Vcc via resistor 226, and provides a precision voltage reference of 2.5 V at junction 228 for closing and sealing detection circuits 202 and 204. A voltage reference corresponding to a motor current of approximately 10 amperes (A) is generated at junction 230 by the voltage divider 232, and is supplied to the inverting input of closing detection circuit comparator 234 via resistor 236. A voltage reference corresponding to a motor current of approximately 5 A is generated at junction 238 by the voltage divider 240, and is supplied to the inverting input of sealing detection circuit comparator 242 via an RC timing circuit comprising the resistor 243 and the capacitor 244. In each case, the voltage reference is compared with the actual motor current as deduced by the voltage across shunt resistor 170, such voltage being supplied to the noninverting inputs of comparators 234 and 242 via resistors 246 and 248, respectively. As described below in reference to FIG. 6*b*, the reference voltage developed by divider 240 is subject to being overridden by the LOGIC SEQUENCE CIRCUIT 190 during the closing portion of the pull down sequence via the line 245.

The closing detection circuit 202 further includes a feedback resistor 250, and an inverter 252 connecting comparator 234 to the output line 198. When the actual motor current is lower than the 10 A reference defined by the divider 232, the comparator output is at a logic zero potential (low), and inverter 252 drives the output line 198 to a logic one potential (high). When the actual motor current exceeds the 10 A reference, the comparator output is high, and inverter 252 drives the output line 198 low to signal that the 10 A reference has been exceeded. An RC timing circuit comprising resistor 254 and capacitor 256 initializes the output line 198 to a high potential upon initial application of the operating voltage Vcc.

The sealing detection circuit 204 further includes a feedback resistor 258, and an inverter 260 connecting comparator 242 to the output line 200. When the actual motor current is lower than the 5 A reference defined by the divider 240, the comparator output is at a low potential, and inverter 260 drives the output line 200 to a high potential. When the actual motor current exceeds the 5 A reference, the comparator output is high, and inverter 260 drives the output line 200 low to signal that the 5 A reference has been exceeded. An RC timing circuit comprising resistor 262 and capacitor 264 initializes the output line 200 to a high potential upon initial application of the operating voltage Vcc.

Referring now to FIG. 6*b* and the LOGIC SEQUENCE CIRCUIT 190, control of the relay coil energization is performed by a pair of logical flip-flop circuits, designated by the reference numerals 270 and 272. Flip-flop circuit 270 energizes the relay coil 160 and overrides the 5 A sealing current reference when the operating voltage Vcc is initially supplied to begin the closing portion of the pull down sequence. Flip-flop circuit 272 is responsive to the current limit signals on output lines 198 and 200 for terminating the closing portion of the sequence and controlling activation of the sealing portion.

The flip-flop circuit 270 comprises a pair of cross-coupled NAND-gates 274 and 276. The Q output at junction 278 is connected to the output line 192 via inverter 280 for controlling the energization of closing relay coil 160. The inverter 282, also connected to the Q output junction 278, provides a latching signal for wake-up circuit 206 on line 196 during the energization of solenoid coil 160. The Q-bar output at junction 284 is connected via resistor 286 to the base transistor 288, which operates when conductive to disable the sealing detection circuit reference by increasing it from 5 A to a value in excess of 10 A. The junction 290 of an RC timing circuit comprising the resistor 292 and the capacitor 294 is connected as an input to NAND-gate 274 for ensuring an initial condition of the NAND-gates 274 and 276 for performing the above-described functions on initial application of the operating voltage Vcc. An RC timing circuit comprising the capacitor 296 and the resistor 298 couple the flip-flop circuits 270 and 272 as explained below to provide a controlled pause between the closing and sealing portions of the pull down sequence.

The flip-flop circuit 272 also comprises a pair of cross-coupled NAND-gates 300 and 302. A coupling capacitor 303 serves to engage the sealing portion of the pull down sequence if the motor current fails to reach the closing current reference, as explained below. The Q output at junction 304 is connected to the output line 194 via buffer amplifier 306 for controlling the energization of sealing relay coil 162, and also to the NAND-gate 276 via line 298 for controlling the transition between the closing and sealing portions of the pull down sequence. The pull-up resistor 308 provides a normally high input for amplifier 306. The Q-bar output at junction 310 is connected as an input to inverter 312, which provides a latching signal for wake-up circuit 206 on line 196 during the energization of relay coil 162.

The operation of flip-flop circuit 172 is controlled by the sealing and closing current limit signals on output lines 200 and 198. The line 200 is connected as an input to NAND-gate 300 via diode 316, the pull-up resistor 318 providing a normally high input level. An RC timing circuit comprising the resistor 320 and the capacitor 322 provide an initial override of the sealing current limit signal so that flip-flop circuit 272 is insensitive to the inrush and initial load pick-up current which occurs at the initiation of motor operation. The other input of NAND-gate 300 is normally maintained high by the parallel combination of pull-up resistor 324, and diode 326 which isolates the coupling capacitor 303. The line 198 is connected directly as an input to the NAND-gate 302, the pull-up resistor 328 providing a normally high input level.

The operation of the control circuit of this invention for a typical deck lid pull down sequence will now be described. The sequence begins with momentary depression of switch 218 by the operator of the vehicle, which biases wake-up circuit transistor 212 conductive develop operating voltage Vcc at junction 208. At such point, the Q outputs of flip-flop circuits 270 and 272 both assume a high potential, thereby (1) latching transistor 212 conductive via inverter 282, (2) energizing closing relay coil 160 via inverter 280, and (3) overriding the sealing current reference via transistor 288. In addition, the capacitor 296 charges to the indicated polarity.

Figure 7:
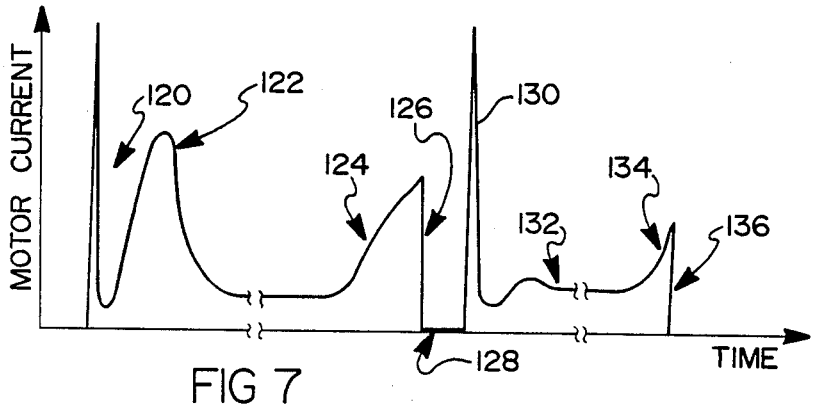
FIG. 7 graphically depicts the electrical current supplied to the motorized drive unit of FIG. 1 in the course of a typical pull down sequence.

The RC timing circuit comprising resistor 320 and capacitor 322 prevents flip-flop circuit 272 from changing states during the inrush and initial load pick up phase of the closing, designated by the reference numerals 120 and 122 in FIG. 7, even though the motor current during such phase exceeds the closing circuit reference of 10 A. In a mechanization of the present invention, an RC time constant of 1.8 seconds was found to be adequate. Following such delay, the motor current should be well below the 10 A reference. When the deck lid panel 10 has been sufficiently closed to mechanically couple the striker 28 and latch bolt 26, the motor current rises as designated by the reference numeral 124 in FIG. 7.

When the motor current exceeds the closing detection circuit reference of 10 A, the output of inverter 252 on feedback line 198 goes low, reversing the output state of flip-flop circuit 272. At such time, amplifier 306 goes low to energize the sealing relay coil 162, and capacitor 296 begins discharging through the resistor 297. The flip-flop circuit 270 remains in its initial state until the voltage across capacitor 296 falls to a logic zero potential. As a result, the relay coils 160 and 162 are concurrently energized, connecting both motor terminals 164 and 166 to the same potential and the motor current is interrupted as indicated by reference number 126. Furthermore this establishes a delay interval, as designated by the reference numeral 128 in FIG. 7.

When capacitor 296 is sufficiently discharged, the flip-flop circuit 272 changes state, deenergizing the closing relay coil 160, and biasing transistor 288 nonconductive. The wake-up transistor 212 is maintained conductive at such point by the inverter 312 of flip-flop circuit 272. At such time, the motor 38 is energized to rotate in the clockwise direction, resulting in the inrush current designated by the reference numeral 130 in FIG. 7. However, the current reference of the sealing detection circuit 204 is maintained relatively high by the capacitor 244, and the reference is not returned to its nominal 5 A level until the higher capacitor voltage is discharged through the resistors 241 and 243. By that time, the motor current will have stabilized as indicated in FIG. 7. Thereafter, the sealing detection circuit 204 compares the motor current with the 5 A reference defined by the divider 240.

As the cam follower portion of striker 28 reaches the end of travel in cam slot 92, the motor current increases above the 5 A reference current as designated by the reference numeral 134 in FIG. 7. At such time, the comparator 242 changes state, and the output of inverter 260 falls to a low potential to change the state of flip-flop circuit 272. This deenergizes the sealing relay coil 162, and unlatches the wake-up circuit transistor 212, completing the pull down sequence. Accordingly, the motor current is interrupted as indicated by reference number 136 in FIG. 7.

If the control circuit is operated with the battery 146 in a near-discharged condition, it is possible that the 10 A closing reference defined by the divider 232 will never be exceeded. In such event, the capacitor 303 will become sufficiently charged to independently change the state of the flip-flop circuit 272, thereby initiating the sealing portion of the sequence. In a mechanization of the illustrated circuit, an RC time constant (resistor 324, capacitor 303) of approximately 10 seconds was found to be satisfactory.

In view of the above, it will be seen that the control circuit of this invention provides inherent obstacle detection. If the panel 10 encounters an obstruction in the closing portion of the pull down sequence, for example, the increased load will cause the motor current to exceed the 10 A reference defined by the divider 232. This will result in a reversal of the motor 38 just as though the striker 28 and latch bolt 26 had been coupled. Thus, the cable 52 will extend, allowing the panel to raise to its normal open position. Subsequent depression of the switch 218 will initiate a new pull down sequence.

Thus it is seen that the invention provides a new and improved motorized pull down unit for a deck lid in which the vertical forces imposed on the striker are not transmitted into the motorized drive unit of the pull down mechanism.

The embodiments of the invention in which an exclusive property or privilege is claimed are defined as follows:

1. In a vehicle body having a hinged compartment panel spring loaded for movement between open and closed positions with respect to a compartment defined by a body panel, and a latch mechanism including first and second latch elements of which one is a striker and the other is a latch, and one is mounted on the compartment panel and the other is mounted on the body panel, a pull down mechanism for pulling the compartment panel to the fully closed position after closing movement latches the latch and striker together, comprising:

a housing mounting the first latch element on the body panel for vertically reciprocating movement between an extended position in which the first latch element is poised for latching engagement with the second latch element and a retracted position pulling the compartment panel to the closed position with respect to the body panel, a slide member mounted on the housing for horizontally reciprocating movement in a path normal to the vertical reciprocating movement of the first latch element, motor means operably connected to the slide member to horizontally reciprocate the slide member, and cam means including a cam surface and a cam follower acting between the first latch element and the slide member and adapted to vertically reciprocate the first latch element in response to horizontal reciprocation of the slide member, said cam means being characterized by a cam surface angularly inclined with respect to the horizontal to provide said vertical reciprocation of the first latch element and consequent movement between the retracted and extended positions upon horizontal reciprocation of the slide member, and a horizontal extending dwell surface at the end of the inclined cam surface providing the retracted position of the first latch element in which the compartment panel is closed whereby a load imposed on the compartment panel in the direction to pry open the compartment panel is prevented from urging movement of the slide member in the direction to extend the first latch member.

2. In a vehicle body having a hinged compartment panel spring loaded for movement between open and closed positions with respect to a compartment defined by a body panel, and a latch mechanism including first and second latch elements of which one is a striker and the other is a latch, and one is mounted on the compartment panel and the other is mounted on the body panel, a pull down mechanism for pulling the compartment panel to the fully closed position after closing movement latches the latch and striker together, comprising:

a housing mounting the first latch element on the body panel for vertically reciprocating movement between an extended position in which the first latch element is poised for latching engagement with the second latch element and a retracted position pulling the compartment panel to the closed position with respect to the body panel, a slide member mounted on the housing for horizontally reciprocating movement in a path normal to the vertical reciprocating movement of the first latch element, motor means operably connected to the slide member to horizontally reciprocate the slide member, and cam means including a cam surface associated with one of the first latch element and the slide member and a cam follower associated with the other of the first latch element and the slide member, said cam means having an inclined cam surface effective to provide said vertical reciprocation of the first latch element and consequent movement between the retracted and extended positions upon horizontal reciprocation of the slide member, a first horizontal extending dwell surface at the end of the inclined cam surface providing the retracted position of the first latch element in which the compartment panel is closed, and a second horizontal extending dwell surface at the end of the inclined cam surface providing the extended position of the first latch element.

3. In a vehicle body having a hinged compartment panel spring loaded for movement between open and closed positions with respect to a compartment defined by a body panel, and a latch mechanism including first and second latch elements of which one is a striker and the other is a latch, and one is mounted on the compartment panel and the other is mounted on the body panel, a pull down mechanism for pulling the compartment panel to the fully closed position after closing movement latches the latch and striker together, comprising:

a housing mounting the first latch element on the body panel for vertically reciprocating movement between an extended position in which the first latch element is poised for latching engagement with the second latch element and a retracted position pulling the compartment panel to the closed position with respect to the body panel, a cam follower associated with the first latch element;

a slide member mounted on the housing for horizontally reciprocating movement upon horizontal reciprocation of the slide member, and having a cam slot receiving the cam follower so that horizontal reciprocating movement of the slide member vertically reciprocates the first latch element, and motor means operably connected to the slide member to horizontally reciprocate the slide member.

4. In a vehicle body having a hinged compartment panel spring loaded for movement between open and closed positions with respect to a compartment defined by a body panel, and a latch mechanism including first and second latch elements of which one is a striker and the other is a latch, and one is mounted on the compartment panel and the other is mounted on the body panel, a pull down mechanism for pulling the compartment panel to the fully closed position after closing movement latches the latch and striker together, comprising:

a housing mounting the first latch element on the body panel for vertically reciprocating movement between an extended position in which the first latch element is poised for latching engagement with the second latch element and a retracted position pulling the compartment panel to the closed position with respect to the body panel, a cam follower associated with the first latch element;

a slide member mounted on the housing for horizontally reciprocating movement upon horizontal reciprocation of the slide member and having a cam slot receiving the cam follower so that horizontal reciprocating movement of the slide member vertically reciprocates the first latch element, a cable operably associated with a motor and connected to the slide member to pull the slide member horizontally in one direction, and spring means bearing upon the slide member and adapted to urge the slide member in the other direction.

5. In a vehicle body having a hinged compartment panel spring loaded for movement between open and closed positions with respect to a compartment defined by a body panel, and a latch mechanism including first and second latch elements of which one is a striker and the other is a latch, and one is mounted on the compartment panel and the other is mounted on the body panel, a pull down mechanism for pulling the compartment panel to the fully closed position after closing movement latches the latch and striker together, comprising:

a housing mounting the first latch element on the body panel for vertically reciprocating movement between an extended position in which the first latch element is poised for latching engagement with the second latch element and a retracted position pulling the compartment panel to the closed position with respect to the body panel, a cam follower associated with the first latch element;

a slide member mounted on the housing for horizontally reciprocating movement upon horizontal reciprocation of the slide member, and having a cam slot receiving the cam follower so that reciprocating movement of the slide member reciprocates the first latch element, motor means operably connected to the slide member to horizontally reciprocate the slide member, and said cam slot of the slide member having an inclined cam surface effective to provide said vertical reciprocation of the first latch element and consequent movement between the retracted and extended positions, a first horizontal dwell surface at the end of the inclined cam surface providing the retracted position of the first latch element in which the compartment panel is closed so that a load imposed on the compartment panel in the direction to pry open the compartment panel is prevented from urging movement of the slide member in the direction to extend the first latch member, and a second horizontal dwell surface at the other end of the inclined cam surface providing the extended position of the first latch element so that the forced closing movement of the compartment panel latching the second latch element with the first latch element is prevented from urging movement of the slide member in the direction to retract the first latch member, whereby any vertical load imposed on the first latch member when the compartment panel is closed or when the first latch means is extended is not exerted on the motor means.

6. In a vehicle body having a compartment panel hinged for movement about a hinge axis between open and closed positions with respect to a compartment defined by a body panel, and a latch mechanism including first and second latch elements of which one is a striker and the other is a latch, and one is mounted on the compartment panel and the other is mounted on the body panel, a mechanism for pulling the compartment panel to the fully closed position after closing movement latches the latch and striker together, comprising:

a housing mounting the first latch element on the body panel for rectilinear reciprocating movement in a path normal to the compartment panel hinge axis and toward and away from the body panel between an extended position in which the first latch element is poised for latching engagement with the second latch element and a retracted position pulling the compartment panel to the closed position with respect to the body panel, a slide member mounted on the housing for rectilinear reciprocating movement in a path parallel to the hinge axis and normal to the rectilinear reciprocating movement of the first latch element, motor means operably connected to the slide member to reciprocate the slide member, and cam means including a cam surface and a cam follower acting between the first latch element and the slide member and adapted to reciprocate the first latch element in response to rectilinearly reciprocation of the slide member, said cam means being characterized by a cam surface angularly inclined with respect to the path of rectilinear movement of both said first latch elements and said slide member to provide said rectilinear reciprocation of the first latch element and consequent movement between the retracted and extended positions upon rectilinear reciprocation of the slide member, and a swell surface at the end of the inclined cam surface and extending parallel to the path of rectilinear reciprocating movement of the slide member and providing the retracted position of the first latch element in which the compartment panel is closed whereby a load imposed on the compartment panel in the direction to pry open the compartment panel is prevented from urging movement of the slide member in the direction to extend the first latch member.

7. In a vehicle body having a compartment panel hinged for movement about a hinge axis between open and closed positions with respect to a compartment defined by a body panel, and a latch mechanism including first and second latch elements of which on is a striker and the other is a latch, and one is mounted on the compartment panel and the other is mounted on the body panel, a mechanism for pulling the compartment panel to the fully closed position after closing movement latches the latch and striker together, comprising:

a housing mounting the first latch element on the body panel for rectilinear reciprocating movement in a path normal to the compartment panel hinge axis and toward and away from the body panel between an extended position in which the first latch element is poised for latching engagement with the second latch element and a retracted position pulling the compartment panel to the closed position with respect to the body panel, a slide member mounted on the housing for rectilinear reciprocating movement in a path parallel to the compartment panel hinge axis and normal to the rectilinear reciprocating movement of the first latch element, motor means operably connected to the slide member to rectilinearly reciprocate the slide member, and cam means including a cam surface associated with one of the first latch element and the slide member and a cam follower associated with the other of the first latch element and the slide member, said cam means having a cam surface inclined with respect to the path of rectilinear movement of both said first latch element and said slide member and effective to provide said rectilinear reciprocation of the first latch element and consequent movement between the retracted and extended positions upon rectilinear reciprocation of the slide member, a first dwell surface at one end of the inclined cam surface and extending parallel with the path of rectilinear movement of the slide member and providing the retracted position of the first latch element in which the compartment panel is closed, and a second dwell surface at the other end of the cam surface and extending parallel to the path of rectilinear movement of the slide member and providing the extended position of the first latch element in which the compartment panel is poised for latching engagement with the second latch element.

* * * * *